US010029890B2

(12) United States Patent
Weber

(10) Patent No.: US 10,029,890 B2
(45) Date of Patent: Jul. 24, 2018

(54) PASSENGER CONVEYOR SYSTEM

(71) Applicant: KONE Corporation, Helsinki (FI)

(72) Inventor: Ralf Weber, Duisburg (DE)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 15/395,242

(22) Filed: Dec. 30, 2016

(65) Prior Publication Data

US 2017/0217734 A1 Aug. 3, 2017

(30) Foreign Application Priority Data

Feb. 1, 2016 (EP) ..... 16153574

(51) Int. Cl.
*B66B 23/14* (2006.01)
*B66B 23/00* (2006.01)

(52) U.S. Cl.
CPC ..... *B66B 23/14* (2013.01); *B66B 23/00* (2013.01)

(58) Field of Classification Search
CPC ..... B66B 23/14
USPC ..... 198/321, 322, 323, 329, 332, 860.1, 198/861.1, 861.2
See application file for complete search history.

(56) References Cited

U.S. PATENT DOCUMENTS 2,664,990 A * 1/1954 Georgiev ..... B66B 21/02 198/321
3,834,513 A * 9/1974 Miura ..... B66B 23/145 198/332
5,476,155 A * 12/1995 Nakatani ..... B66B 9/0815 187/201
5,899,314 A * 5/1999 Kwon ..... B66B 23/147 198/326
7,533,765 B2 * 5/2009 Kwon ..... B66B 23/14 198/321
2005/0061607 A1 3/2005 Krampl

FOREIGN PATENT DOCUMENTS

EP 1 262 440 A1 12/2002
JP 2006-103825 A 4/2006

OTHER PUBLICATIONS

US Patent Application Publication, US2006/0254878 A1, Krampl, Nov. 16, 2006.*
US Patent Application Publication, US2017/0043981 A1, Matheisl et al. Feb. 16, 2017.*

* cited by examiner

*Primary Examiner* — Douglas A Hess
(74) *Attorney, Agent, or Firm* — Birch, Stewart, Kolasch & Birch, LLP

(57) ABSTRACT

The invention refers to a passenger conveyor system comprising a longitudinal conveyor frame having at its longitudinal ends mounting points, a conveyor unit mounted to the conveyor frame and comprising an endless conveyor means comprising an upper conveyor track and a lower return track and turnover means at the conveyor unit ends to turn the conveyor means from the conveyor track to the return track and vice versa, and at least one compensation means comprising a compensation mass which is in transversal direction of the conveyor frame movably mounted to the conveyor frame via a spring means or a swing drive.

20 Claims, 5 Drawing Sheets

PASSENGER CONVEYOR SYSTEM

BACKGROUND OF THE INVENTION

The present application refers to a passenger conveyor system comprising a longitudinal conveyor frame having at its ends mounting points to fix the conveyor frame to a building or environment which environment may comprise concrete structures at building floors, public places, malls or airports. Furthermore, the passenger conveyor system preferably comprises a conveyor unit mounted to the conveyor frame comprising an endless conveyor means with an upper conveyor track and a lower return track as well as turnover means at the conveyor unit ends to turn the conveyor means from the conveyor track to the return track and vice versa. Such passenger conveyor systems are preferably known as an escalators, moving ramps or moving sidewalks, whereby the endless conveyor means usually comprise steps or pallets which are connected by endless drive chains.

Nowadays the conveyor frames may reach a considerable length of several tenth of meters and often due to design specifications of an architect the passenger conveyor frame is only fixed at its ends so that the frame runs free over its entire length. Due to this fixing of the frame in the environment only at its ends the passenger conveyor system is prone to (natural or implied) swing, which is also enhanced by the use of the passenger conveyor system.

SUMMARY OF THE INVENTION

It is object of the present invention to reduce the susceptibility of the passenger conveyor system to swing.

The object of the invention is solved with a passenger conveyor system and a method according to the claims. Preferred embodiments of the invention are subject matter of the corresponding dependent claims. Embodiments of the invention are also described in the description part as well as in the drawings.

According to the invention the passenger conveyor system comprises at least one compensation means comprising at least one compensation mass movably mounted to the conveyor frame via a corresponding spring means or swing drive. This is a kind of passive system and allows the compensation mass to swing anti-cyclic to the frame to reduce the amplitude of natural oscillation of the conveyor, particularly if it is extending cantilever like over a wide span and is thus susceptible to natural oscillation.

Preferably in the compensation means at least one damper is mounted between the compensation mass and the conveyor frame. The compensation means is then designed to act as a tuned mass damper to eliminate the natural oscillation of the conveyor track.

The spring means may only be configured to control the movement of the compensation mass but it also may be used to carry the weight of the compensation mass (in vertical direction).

Preferably the damper is mounted parallel to a spring of the spring means. Thus allows an easier calculation of the tuning of springs and dampers to obtain an anticyclical movement of the compensation mass to the natural oscillation of the conveyor frame.

In the most preferred embodiment the compensation mass together with its spring means and its damper forms a tuned mass damper.

The damper represents energy absorbing element of the suspension of the compensation mass. It can be embodied as a separate component based on restricted flow of viscous fluid, mechanical friction etc., but it also can mean spring means with high internal friction, like rubber mounts, or any other known ways of absorbing kinetic energy of moving bodies. Thus the damper and the spring means may be an integrated component.

Preferably the compensation mass is movably mounted on a transversal guide means, so that the guide means has the double function to stiffen the conveyor frame. This solution is very economical and space saving.

In a preferred embodiment of the invention the compensation mass rests on at least two sides against a spring which is supported on a stopper mounted to the conveyor frame. This solution allows a very simple movable mounting of the compensation mass to the conveyor frame.

In an active system the swing drive is configured to move the compensation mass transversally to the longitudinal direction of the conveyor frame, i.e. in horizontal and/or vertical direction. Further, the passenger conveyor system comprises at least one movement detection means with at least one movement sensor outputting a movement signal to the compensation control. According to this active embodiment the compensation control is configured to detect a swing, e.g. natural vibration of the conveyor frame from the movement signal. The compensation control is further configured to control the compensation means dependent on the movement signal in a way as to move the compensation mass with the measured swing frequency as the conveyor frame but with a phase offset. The phase offset is preferably between 135 and 225 degrees, most preferably 180 degrees so that the swing direction of the compensation mass of the compensation means is exactly opposite to the swing direction of the conveyor frame at the mounting point of the corresponding compensation means. Via this measure the swing of the complete passenger conveyor system, particularly of the conveyor frame, can be reduced essentially.

In a preferred embodiment of the active system the swing drive comprises a motor which could be an electric motor, e.g. a servo motor. Such a swing drive can easily be controlled to a desired rotation velocity and further the phase offset can easily be controlled. Of course, also a linear motor or a linear hydraulic mechanic or pneumatic drive system can be used, e.g. a rack and pinion drive.

In a preferred embodiment of the active system an electric motor is used having eccentrically connected to its output shaft a drive pin, which counter-acts with a drive slot arranged in a slide, which drive slot extends perpendicularly to the movement direction of the slide. The slide thereby carries or forms the compensation mass. Via this arrangement the circular motion of the output shaft is via the drive pin in connection with the drive slot transferred into a linear motion of the compensation mass perpendicular to the longitudinal action axis of the conveyor frame, particularly in the horizontal direction. The motor speed should be controllable at very low speeds of 0, 1 to 20 RPM. In a preferred embodiment of this system the drive pin is mounted via an adjustment mechanism to the motor output shaft where by the offset of the drive pin with regard to the axis of the output shaft is adjustable. Via this measure the amplitude of the movement of the compensation mass is adjustable, so that the compensation means can also be controlled which will regard to its amplitude to better meet the amplitude of the swing of the conveyor frame. Alternatively, a linear motor, a hydraulic drive or a rack and pinion drive may be used for the moving of the compensation mass transversal to the conveyor frame.

Preferably at the specified location of each compensation means of the active system a corresponding movement sensor is located and the compensation mass of each compensation means is controlled to swing with a preset offset in a swing frequency measured by the corresponding movement sensor located at the corresponding specified location. Via this measure different swing regimes of the total swing of the conveyor frame at different locations can be met by the location and separate control of several separate compensation means. By measuring the swing frequency and swing phase at each of this specified locations where the compensation means are located the total natural and/or implied swing of the conveyor frame can efficiently be reduced.

In a preferred embodiment of the active system the passenger conveyor system comprises a first movement sensor located on at least one end of the passenger conveyor system frame outputting a first movement signal and at least one second movement sensor outputting a second movement signal and being connected in a distance of either end of the passenger conveyor frame, preferably in the middle third of the length of the passenger conveyor frame. In this case the signal difference between the first and second movement signals is used for the swing detection of the passenger conveyor frame. Via this arrangement a swing of the building itself or of its environment can be considered and subtracted from the measured movement signals so that only the effective swing of the frame itself and not that of the building or environment is compensated via the compensation means. This is of course not necessary when a movement sensor is used which measures the swing of the frame with respect to its environment, e.g. an optical distance detector.

Preferably the swing drive of the active system has an adjustment means for adjusting the amplitude of the movement of the compensation mass. Also in this case the amplitude of the swing of the compensation mass can be adjusted to better meet or correspond to the measured swing amplitude of the conveyor frame.

It is preferable that the compensation means is located in the longitudinal direction of the conveyor frame at points where the swing amplitude of the conveyor frame is assumed to be at its maximum. This is in longitudinal direction of the conveyor frame particularly the middle and/or at the points separating the thirds of length and/or quarters of the length of the conveyor frame (if several compensation means are used). Via this measure it is achieved that the compensation means is active in swing nods of the conveyor frame, where the swing is largest in amplitude.

Although the phase offset may be such that the swing of the conveyor frame is reduced, which is surely the case with any angles preferably between 135 degrees and 225 degrees, whereby the optimum phase offset would be 180 degrees which means the swing of the compensation mass is exactly opposite to the swing direction of the conveyor frame at said location.

As it is mentioned above, the passenger conveyor system is preferably an escalator, a moving ramp or a moving sidewalk etc. Preferably any mounting points of the conveyor frame for the fixing of the frame to a building or environment are located only at its ends, which is a common fixing method for moving ramps and escalators which run generally free over their length, which makes the conveyor frame particularly susceptible for any swing, e.g. natural oscillation. In this case the compensation means is particularly efficient as the susceptibility of the conveyor frame to swing is essentially reduced by the compensation means. Of course, the invention may also be applied to passenger conveyor systems as e.g. moving sidewalks, where the frame is mounted to the environment not only at its ends but also somewhere in-between.

Preferably the compensation means is mounted to the middle of the conveyor frame, preferably in its transversal direction as well as in its longitudinal direction. The advantage of this solution is that at least with respect to the longitudinal direction at this point the swing of the conveyor frame is assumed to be at its maximum.

In a preferred embodiment of the invention several compensation means are mounted to the conveyor frame at specified locations in a mutual distance in the longitudinal direction of the frame.

Preferably the compensation means is configured to allow movement of the compensation mass in a horizontal direction. Of course the compensation mass can also be embodied to be movable in vertical direction. Different compensation means can be located along the conveyor frame which are specified to either allow movement the corresponding compensation mass in horizontal or vertical direction, if desired. Of course, a compensation means may also be configured to move the compensation mass in horizontal as well as in vertical direction.

The invention also refers to a method for reducing natural frequency or natural resonance or any kind of vibration of a passenger conveyor system comprising a longitudinal conveyor frame having at its longitudinal ends mounting points for mounting the frame to an environment. Further the conveyor system preferably comprises at least one conveyor unit mounted to the conveyor frame and comprising at least one endless conveyer means with an upper conveyor track and a lower return track and turnaround means at the conveyor unit ends to turn the conveyor means of the conveyer track to the return track and vice versa. According to the invention a compensation mass is connected movably to the conveyor frame via a spring means or swing drive. In case of the spring means the compensation system is used as a tuned mass damper to dampen the natural oscillation of the conveyor system. With regard to the features and advantages of the invention it is referred to the description of the invention in connection with the passenger conveyor system.

One compensation means may e.g. have several compensation masses from which at least one is movable in horizontal direction at least and one is movable in vertical direction. Thus one compensation means may compensate for swings in vertical and horizontal directions, even independently of each other.

It is apparent for the skilled persona that single features of the invention can be provided unitary or can be provided as several fold. The invention could only have one compensation means in the passenger conveyor system or several compensation means. One compensation means may comprise one compensation mass or several compensation masses. Preferably compensation means are mounted to the frame at points where the swing amplitude is assumed to be at its maximum, e.g. preferably in the middle, between thirds and/or quarters of the frame lengths.

Following expressions are used as a synonym: frame—conveyor frame; movement sensor—sensor; natural oscillation—natural vibration—natural swing In the active system the movement sensors are preferably acceleration sensors but could also be any sensors, e.g. optical sensors which measure the distance of a specified point of the conveyor frame to a reference point or -surface of the surrounding environment. It is evident that all kinds of sensors are adapted as movement sensors which are able to detect a movement of the conveyor frame with respect to its surrounding environment.

A tuned mass damper is a per se known system for damping the amplitude in one larger oscillator (conveyor frame) by coupling it to a second smaller oscillator (compensation mass). Via a per se known tuning of the compensation mass, the spring means and dampers, the compensation means can be designed so that the compensation mass swings anti-phase to the natural oscillation of the conveyor frame, thereby efficiently reducing the natural oscillation of the conveyor. Thus, if tuned properly the maximum amplitude of the first oscillator in response to a periodic driver will be lowered and much of the vibration will be 'transferred' to the second oscillator.

The damper may be any kind of per se known damping means as e.g. hydraulic dampers, oil dampers or pneumatic dampers.

Of course, separate vertical and horizontal compensation means may be arranged. It is also possible to provide a compensation means which supports a compensation mass via vertical and horizontal springs so that the spring means supports the compensation mass against the frame in horizontal as well as in vertical direction. Of course on each side of the compensation mass several springs may be provided.

BRIEF DESCRIPTION OF THE DRAWINGS

The invention is now descripted via an exemplary embodiment in connection with the schematic drawings. In these drawings

DESCRIPTION OF A PREFERRED EMBODIMENT

Figure 1:
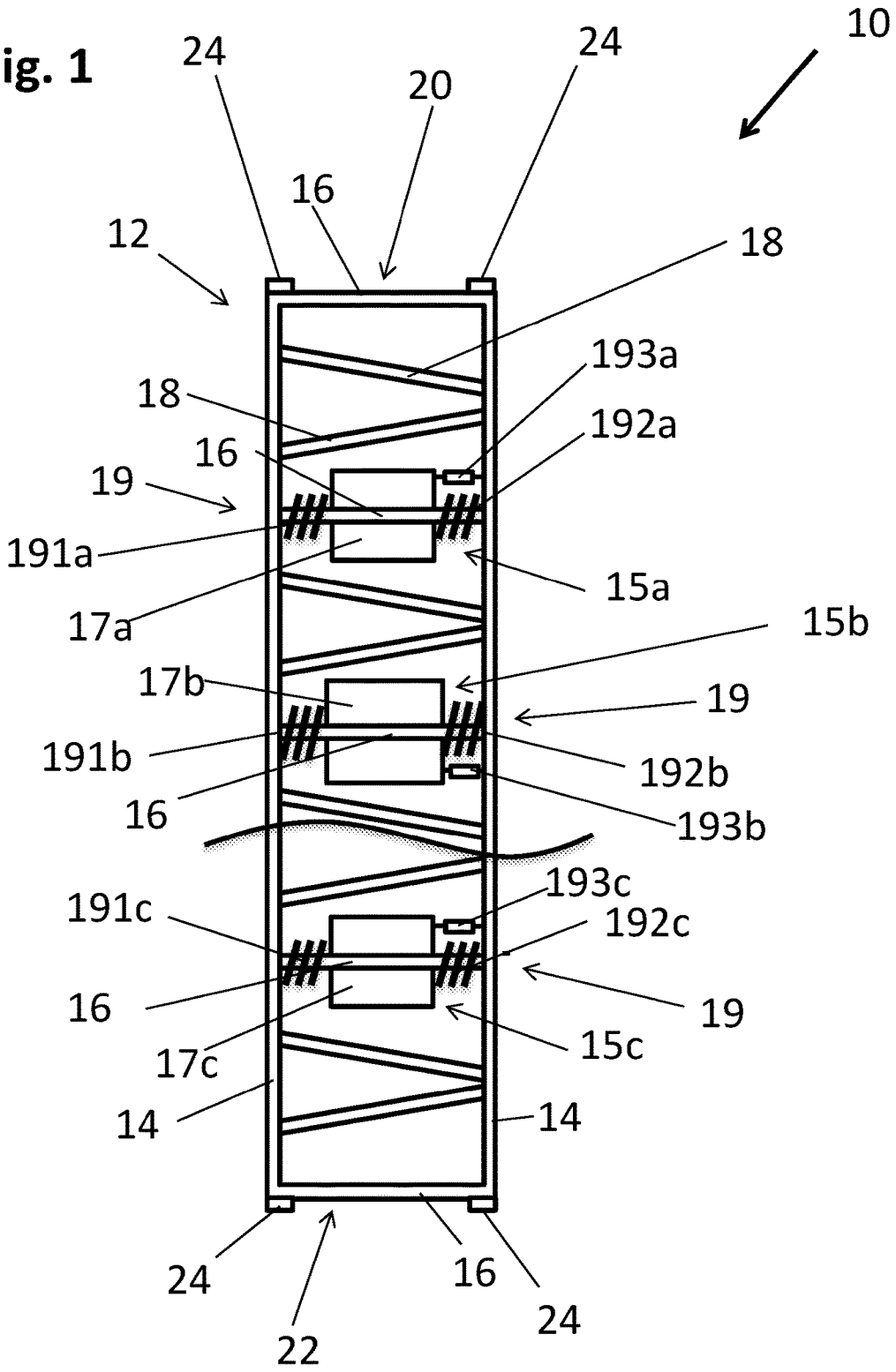
FIG. 1 shows a conveyor frame with a passive compensation means acting as a tuned mass damper.

FIG. 1 shows parts of a passenger conveyor system 10, comprising a conveyor frame 12, on which a conveyor unit (not shown) for example an escalator or moving sidewalk may be installed. The conveyor unit itself is per se known and is therefore not shown for clarity purposes. The conveyor frame has a grid-like with longitudinal beams 14, transversal beams 16 as well as diagonal beams 18. At both ends 20, 22 of the conveyor frame 12 mounting points 24 are located to mount the conveyor frame to an environment, for example to a building. Of course, the conveyor frame 12 also has mounting points for the conveyor unit which are not show for clarity reasons. Further, the conveyor frame 12 has beams extending out of the drawing plane, was the base cross-sectional form so a frame 12 is a U. The drawing shows only the bottom part of said U-frame 12.

After the first, second and third quarter of the length of the frame 12 passive compensation means 15*a* to 15*c* are mounted to the conveyor frame 12, preferably to the transversal beams 16. These compensation means 15*a-c* form tuned mass dampers and comprise a compensation mass 17*a* to 17*c* movingly supported against the frame 12 via a spring means 19 formed by first and second springs 191*a-c*, 192*a-c* located on both sides each compensation mass 17*a-c*. Furthermore, preferably dampers 193*a-c* are located between the conveyor frame 12 and the corresponding compensation mass 17*a-c*. While these compensation means 15*a-c* are shown to extend in horizontal direction they also may extend in vertical direction. In the figure the transversal beams 16 may optionally form horizontal guide means for the movement of the compensation masses 17*a-c*.

Of course, separate vertical and horizontal compensation means may be arranged. It is also possible to provide a compensation means which supports a compensation mass via vertical and horizontal springs so that the spring means supports the compensation mass against the frame in horizontal as well as in vertical direction. Of course on each side of the compensation mass several springs may be provided.

Via a per se known tuning of the compensation mass, the spring means 19 and the dampers 193 the compensation means 15 can be designed so that the compensation mass 17 swings anti-phase to the natural oscillation of the conveyor frame 12, thereby efficiently reducing the natural oscillation of the conveyor 10.

Figure 2:
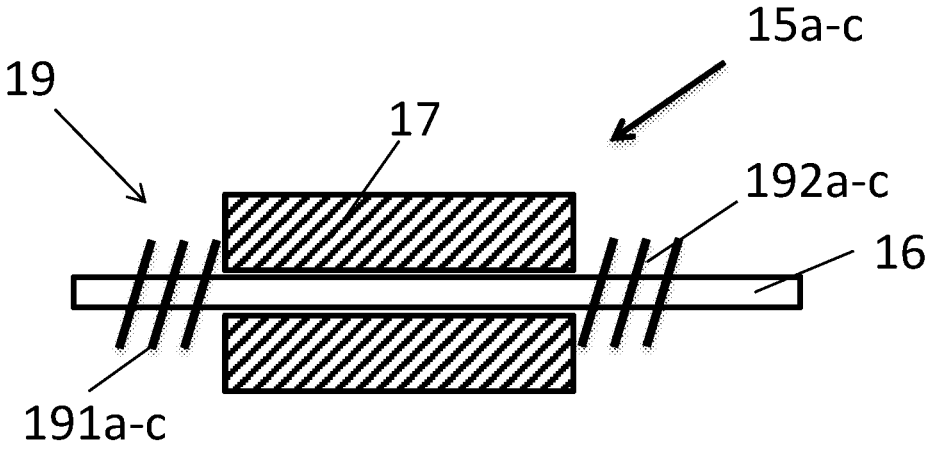
FIGS. 2 to 5 show different embodiments of passive compensation means acting as a tuned mass damper.

FIG. 2 shows a passive compensation means 15*a-c* according to FIG. 1 in greater detail. It shows the transverse beam 16 of the conveyor frame acting as a guide beam for the horizontal movement of the compensation mass. The spring means 19 comprises springs 191, 192 on both sides of the compensation mass, which springs rest against stoppers (not shown) of the conveyor track. Optional dampers are not shown but are located as shown in FIG. 1.

Figure 3:
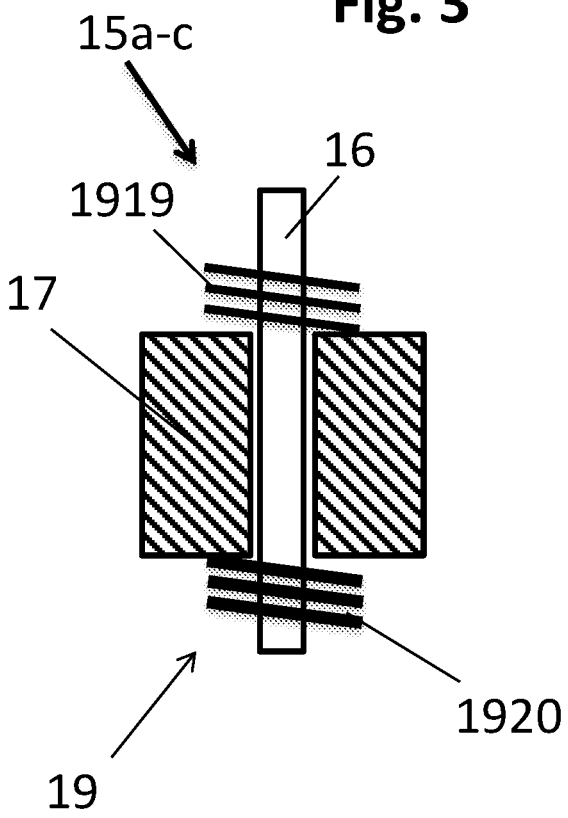

FIG. 3 shows the compensation means of FIG. 2 but in a vertical arrangement. On this behalf the lower spring 1920 has a higher spring constant than the upper spring 1919. Optionally the upper spring may be left away. The optional dampers are not shown in this figure, but are located vertically above and/or below the compensation mass 17.

Figure 4:
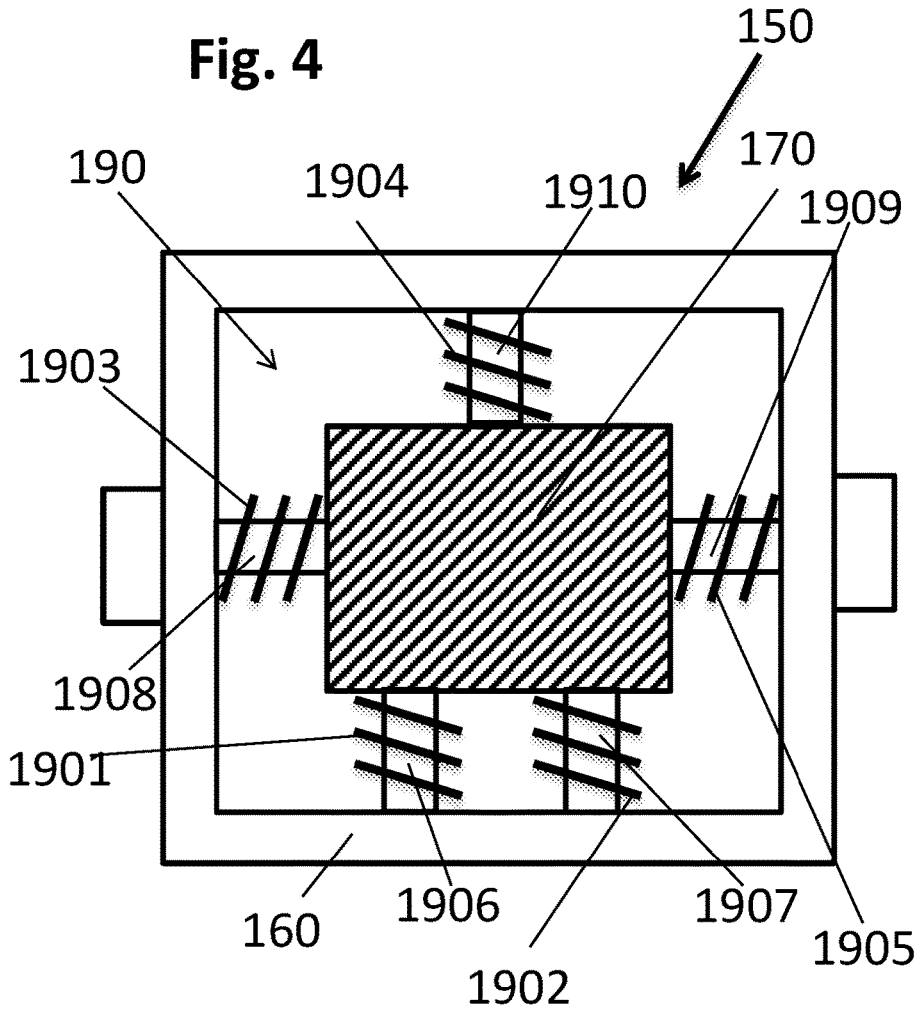

FIG. 4 shows a passive compensation means 150 a rectangular transverse frame 160 instead a transverse beam 16 of FIG. 1. The transverse frame 160 accommodates a heavy compensation mass of e.g. 20 to 200 kg, particularly 50 to 100 kg, which is supported within the frame by a spring means 190 consisting of five springs 1901, 1902, 1903, 1904, 1905, each of them resting against the transverse frame 190. Parallel to each spring 1901-1905 a damper is mounted between the transverse frame 160 and the compensation mass 170. Via the spring means the compensation mass is movably supported within the transverse frame 190 in horizontal as well as in vertical direction. Via tuning of dampers 1906-1910 and springs 1901-1905 it can be achieved that the compensation mass swings anti-cyclic to the natural oscillation of the conveyor track in the location where the compensation means 150 is mounted to the frame 12.

Figure 5:
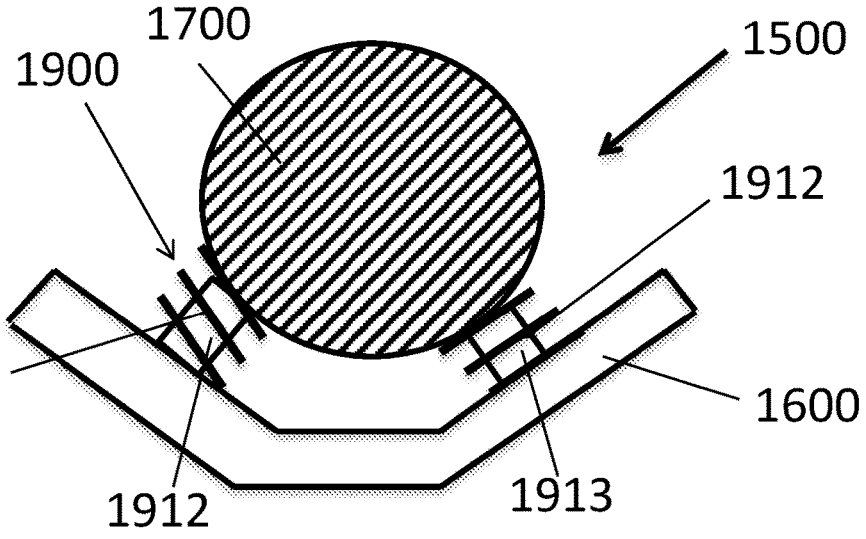

FIG. 5 shows a further embodiment of a passive compensation means 1500 comprising a circle-cylindrical compensation mass 1700 which is supported via mutually tilted springs 1911, 1912 against tilted flanks of a transverse profile 1600 of the conveyor frame 12. If this system is rotation symmetric the compensation mass is ball shaped and three or four springs 1911, 1912 shall be necessary to support the compensation weight. Also here, optionally dampers 1912, 1913 are located between the transverse profile 1600 and the compensation mass 1700 so that the compensation means can be tuned as a tuned mass damper.

All the passive compensation means of FIGS. 1 to 5 act preferably as tuned mass dampers to reduce the natural oscillation of the conveyor system, particularly of the conveyor frame 12.

Figure 6:
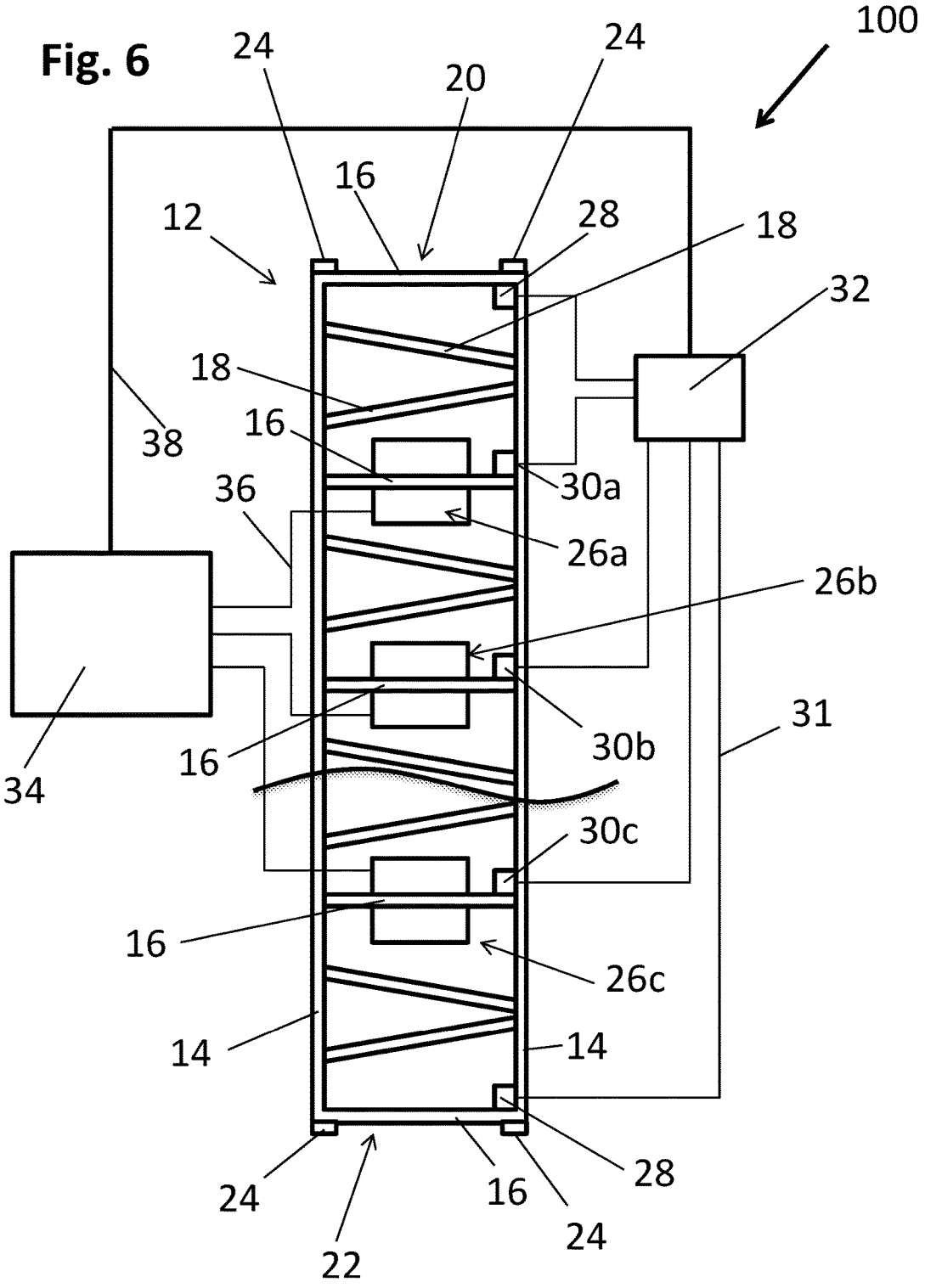
FIG. 6 shows a conveyor frame with an active compensation means.

FIG. 6 shows an conveyor system 100 which is similar to the conveyor system 10 of FIG. 1. In contrast to FIG. 1 the compensation means 27*a-c* of FIG. 6 are active compensation systems 26*a-c* having a compensation mass or weight 27 which is actively driven by a swing drive 29, which compensation means 26 is shown in greater detail in FIGS. 7 and 8. In all figures identical or functional similar parts carry the same reference numerals.

In FIG. 6 three active compensation means 26*a* to 26*c* are mounted to the conveyor frame 12 in longitudinal direction after the first, second and third quarter of the length of the frame 12, preferably to corresponding transversal beams 16. Furthermore, at the ends 20, 22 of the conveyor frame first movement sensors 28 are mounted. In a distance to the ends 20,22 second movement sensors 30*a* to 30*c* are mounted to the frame 12 in the vicinity of the corresponding compensation means 26*a* to 26*c*. Each movement sensor 28, 30*a-c* is connected via a corresponding connecting line 31 to a movement detection means 32 which again is connected via a connection bus 38 to a compensation control 34. The compensation control 34 is again connected via control lines 36 with each of the compensation means 26. Instead of the connecting line also wireless transmission can be used for the data transfer from the movement sensors 28, 30 to the movement detection means 32.

The passenger conveyor system according to FIG. 6 works as follows: The movement detection means 32 determines for each location of a second movement sensor 30 the swing frequency of the conveyor frame 12 at this particular location. This is done by subtracting the signal of one of the first movement sensors 28 (or their arithmetic mean value) from the signal of the corresponding second movement sensor 30 a, b, c. Via this measure the swing frequency as well as the swing phase at each of the specific locations of the three second movement sensor 30*a*, 30*b*, 30*c* can be detected by the measurement detection means 32. The corresponding signals are processed and transmitted via a connecting bus 38 to the compensation control 34 which controls via corresponding control lines 36 each of the compensation means 26*a* to 26*c* according to the swing frequency and swing phase as measured by the corresponding second moving sensors 30*a* to 30*c*. Via this measurement the natural swing or natural resonance or vibration of the conveyor frame 12 can be effectively reduced which is preferable particularly in case of long conveyor frames which are mounted only at their ends to the environment, e.g. different floors of a shopping center.

Figure 7:
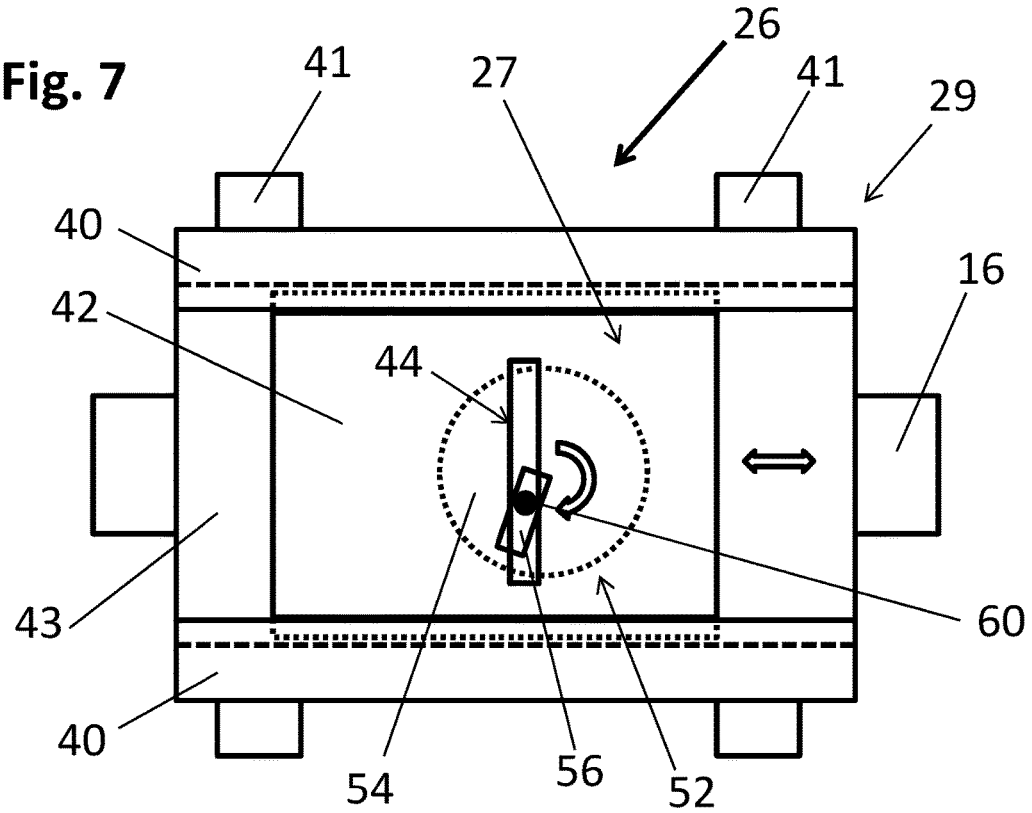
FIG. 7 shows a top view of an active compensation means of FIG. 6.
Figure 8:
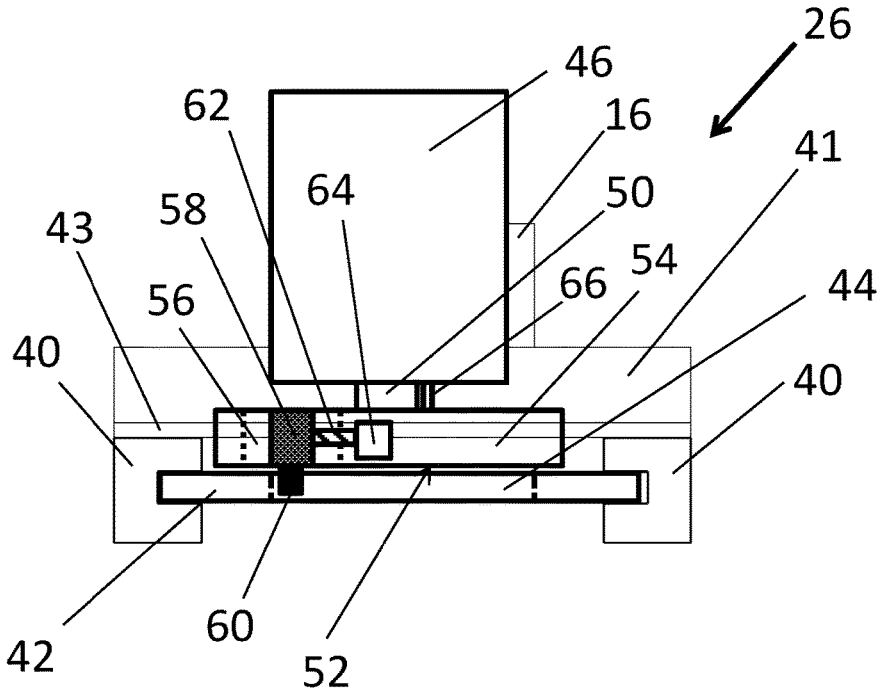
FIG. 8 shows a side view of the active compensation means of FIG. 7.

FIGS. 7 and 8 show an example of the compensating means 26 which is preferably used in FIG. 1. The compensation means 26 comprises generally at least on compensation mass 27 moved by a swing drive 29 in transversal direction of the conveyor frame 12. The swing drive 29 comprises two tracks 40 mounted to a base plate 43 and extending perpendicular to the longitudinal direction of the conveyor frame 12. Between the two tracks 40 a slide 42 with a high mass is guided in the transverse direction of the conveyor frame as indicated by the double arrow aside of the slide 42. The slide 42 consist of a heavy metal plate forming the compensation mass 27. The plate 42 has a drive slot 44 which is arranged perpendicular to the movement direction of the slide 42. The base plate 43 is mounted on carrier beams 41 which are again mounted to the transverse beams 16 of the conveyor frame 12. The compensation means 26*a* to 26*c* comprises a motor 46, which is preferably mounted via supports 48 preferably to the carrier beams 41. The motor has an output shaft 50 to which a circular adjustment means 52 is mounted. The adjustment means 52 comprises a wheel 54 having a radial slot 56 in which a carriage 58 carrying a drive pin 60 is movable via a thread threaded rod 62 which can be rotated via an adjustment motor 64. The adjustment motor 64 is contacted for example by a brush 66 co-acting with a contact ring on the wheel 54.

Via the control of the adjustment motor 64 the distance of the drive pin from the axis of the output shaft 50 of the motor 46 can be adjusted. Thus, the amplitude of the movement of the slide 42 in the tracks 40 can be adjusted. Accordingly, via the frequency of the motor the swing frequency of the slide 42 can be adjusted and via the control of the adjustment motor 64 the amplitude of the movement of the slide 42 can be adjusted to a desired value according to the movement signals of the corresponding movement sensors 30*a* to 30*c*.

It shall be clear for the skilled person that the embodiment shall not restrict the invention. The invention can be carried out within the scope of the appended patent claims.

LIST OF REFERENCE NUMBERS

10 passenger conveyor system with passive compensation means
12 conveyor frame
14 longitudinal beams
15 passive compensation means (first embodiment)
16 transversal beam
17 compensation mass (first embodiment)
18 diagonal beams
19 spring means
191 first spring
192 second spring
20 first end of the conveyor frame
22 second end of the conveyor frame
24 mounting point
26 active compensation means
27 compensation mass
28 first movement sensor
29 swing drive
30 second movement sensor
31 connecting line
32 movement detection means
34 compensation control
36 control line
38 connecting bus
40 tracks
41 carrier beams
42 slide/heavy metal plate
43 base plate
44 drive slot
46 motor
48 supports
50 motor output shaft
52 adjustment means
54 wheel
56 radial slot
58 carriage
60 drive pin
62 threaded rod
64 adjustment motor
100 passenger conveyor system with active compensation means
150 passive compensation means (second embodiment)
160 transversal frame
170 compensation mass (second embodiment)
190 spring means (second embodiment)
192 springs
193 dampers

1500 passive compensation means (third embodiment)
1600 transversal profile
1700 compensation mass (third embodiment)
1900 spring means (third embodiment)
1901 spring
1902 spring
1903 spring
1904 spring
1905 spring
1906 damper
1907 damper
1908 damper
1909 damper
1910 damper
1919 spring
1920 spring
1911 spring
1912 spring
1912 damper
1913 damper

The invention claimed is:

1. Passenger conveyor system comprising a longitudinal conveyor frame having at its longitudinal ends mounting points, a conveyor unit mounted to the conveyor frame and comprising an endless conveyor means comprising an upper conveyor track and a lower return track and turnover means at the conveyor unit ends to turn the conveyor means from the conveyor track to the return track and vice versa, and at least one compensation means comprising a compensation mass which is in transversal direction of the conveyor frame movably mounted to the conveyor frame via a swing drive;

a compensation control configured to control compensation means including the swing drive, a movement detector including at least one movement sensor outputting a movement signal to the compensation control, whereby the compensation control is configured to detect a swing of the conveyor frame from the movement signal and to control the compensation means so to move the compensation mass with the same swing frequency as the conveyor frame but with a phase offset between 135 and 223 degrees.

2. Passenger conveyor system according to claim 1, wherein at least one damper is mounted between the compensation mass and the conveyor frame.

3. Passenger conveyor system according to claim 2, wherein the damper is mounted parallel to a spring of the spring means.

4. Passenger conveyor system according to claim 3, wherein the compensation means together with the spring means and damper forms a tuned mass damper.

5. Passenger conveyor system according to claim 3, wherein the compensation mass is—in longitudinal direction of the conveyor frame—mounted to the middle of the conveyor frame.

6. Passenger conveyor system according to claim 2, wherein the compensation means together with the spring means and damper forms a tuned mass damper.

7. Passenger conveyor system according to claim 2, wherein the compensation mass is—in longitudinal direction of the conveyor frame—mounted to the middle of the conveyor frame.

8. Passenger conveyor system according to claim 1, wherein the compensation mass is mounted to the middle of the conveyor frame in the longitudinal direction.

9. Passenger conveyor system according to claim 1, wherein the compensation mass is movably mounted on a transversal guide.

10. Passenger conveyor system according to claim 9, wherein the compensation mass rests on both sides against a spring which is supported on a stopper mounted to the conveyor frame.

11. Passenger conveyor system according to claim 1, wherein the compensation mass is movable by the spring means or swing drive in horizontal as well as in vertical direction.

12. Passenger conveyor system according to claim 1, being an escalator or moving side walk.

13. Passenger conveyor system according to claim 1, wherein all mounting points of the conveyor frame for the fixing of the frame to a building or environment are located only at its ends.

14. Passenger conveyor system according to claim 1, wherein several compensation means are mounted to the conveyor frame at specified locations generally equispaced in longitudinal direction of the frame.

15. Passenger conveyor system according to claim 1, wherein the swing drive has an adjustment mechanism for adjusting the amplitude of the movement of the compensation mass.

16. The passenger conveyor system of claim 1 wherein the phase offset is substantially 180 degrees.

17. Method for reducing the natural oscillation or vibration of a passenger conveyor comprising a longitudinal conveyor frame having at its longitudinal ends mounting points, and a conveyor unit mounted to the conveyor frame and comprising an endless conveyor including an upper conveyor track and a lower return track and turnover means at the conveyor ends to turn the conveyor from the conveyor track to the return track and vice versa, at least one compensation means being connected to the conveyor frame and including at least one compensation mass movably connected to the conveyor frame in the transverse direction and a swing drive; a compensation control configured to control compensation means including the swing drive, and a movement detector including at least one movement sensor outputting a movement signal to the compensation control, comprising monitoring the movement signal output from the movement sensor;

detecting a swing of the conveyor frame from the movement signal; and driving the compensation means under control of the compensation control to move the compensation mass with the same swing frequency as the conveyor frame but with a phase offset between 135 and 223 degrees.

18. Method according to claim 17, wherein the compensation means forms a tuned mass damper.

19. Method according to claim 17, making use of a conveyor system comprising:

a longitudinal conveyor frame having at its longitudinal ends mounting points, a conveyor unit mounted to the conveyor frame and comprising an endless conveyor means comprising an upper conveyor track and a lower return track and turnover means at the conveyor unit ends to turn the conveyor means from the conveyor track to the return track and vice versa, and at least one compensation means comprising a compensation mass which is in transversal direction of the conveyor frame movably mounted to the conveyor frame via a spring means or a swing drive.

20. The method of claim 17 wherein the phase offset is substantially 180 degrees.

* * * * *